US005200571A

United States Patent [19]

Gracey

[11] Patent Number: 5,200,571

[45] Date of Patent: Apr. 6, 1993

[54] PRIMER POCKET CLEANER

[76] Inventor: Doyle D. Gracey, P.O. Box 155, Tehachapi, Calif. 93561

[21] Appl. No.: 863,967

[22] Filed: Apr. 6, 1992

[51] Int. Cl.[5] ..... F42B 33/00; F42B 35/02

[52] U.S. Cl. ..... 86/24; 15/104.09; 15/198; 248/112

[58] Field of Search ..... 86/24, 37, 44, 23; 248/110–112; 15/56, 104.09, 104.011, 104.1 R, 104.14, 197, 198, 199, 200, 206, 207

[56] References Cited

U.S. PATENT DOCUMENTS

| | | | |
|---|---|---|---|
| 1,593,044 | 7/1926 | Stubbs | 15/199 |
| 2,325,629 | 3/1943 | Peterson | 300/21 |
| 2,977,618 | 4/1961 | Brisbin | 15/104.1 |
| 3,266,075 | 8/1966 | Conrad | 15/104.03 |
| 3,343,195 | 9/1967 | Menges | 15/179 |
| 3,429,218 | 2/1969 | Olson | 86/24 |
| 4,246,728 | 1/1981 | Leasher | 51/241 |

OTHER PUBLICATIONS

Herter's Wholesale Catalog No. 81, 1971, p. 485.

*Primary Examiner*—Brian S. Steinberger

[57] ABSTRACT

A primer pocket cleaner for cartridge cases has a bundle of bristles mounted in a base with a retractable spring surrounding the bristles. The base is mounted in a motor to rotate the bundle of bristles. The spring keeps the bundle of bristles together while allowing them to vibrate as a cartridge case primer pocket is pressed against the end of the rotating bundle of bristles not mounted into the base.

6 Claims, 4 Drawing Sheets

PRIMER POCKET CLEANER

BACKGROUND OF THE INVENTION

1. Field of the Invention

This invention relates to devices which clean small recesses such as primer pockets including the flash hole. Specifically, this invention pertains to primer pocket cleaners for cartridge cases.

2. Description of Prior Art

There are numerous devices used to clean primer pockets on cartridges. Several have sought to use the advantages of bristle bundles. Such bundles permit bristles smaller than the primer pocket to reach into the primer pocket to clean any residue. Such bundles quickly flare. Flaring is lessened if hard materials are used. However, if the level of hardness is equal to or greater than the hardness of the cartridge case, the bristles go beyond cleaning and abraid the cartridge case.

Using bristles softer than the cartridge case avoids abrasion but results in quicker flaring. Shortening the length of the bristles reduces the flaring effect but results in very short useful life of the cleaner before the bristles are worn away.

Retaining devices such as springs have been used to encase such bundles of bristles. These retaining devices have been anchored to the bundle of bristles or to the base holding the bundle. This attachment keeps the bristles from vibrating. This in turn significantly reduces the bristles ability to remain clean. The bristle bundles are rotated symetrically which permits skips in the cleaning and frequently fails to clean the flash hole. Not only does carbon build up in the flash hole but the bristles themselves retain carbon due to the lack of sufficient vibration.

Accordingly, it is an object of the present invention to use bundles of bristles made of material softer than the cartridge primer pockets to be cleaned. Such bundles of bristles are retained while vibrating and are prevented from flaring apart. The bundle of bristles is to clean with a scrubbing motion which allows the flash hole to be cleaned along with the primer pocket.

SUMMARY OF THE INVENTION

In one embodiment of this invention, a bundle of bristles is mounted to a base. A retractable spring is placed around the bundle but not fastened to the bundle. The spring may slide along the bundle. The base is in turn rotated by a motor or other turning device. The cleaning surface of one end of the bristle bundle is designed flare to hold the spring from sliding off.

In another embodiment, the bundle is mounted slightly off center so a scrubbing effect is produced when the base is rotated.

DESCRIPTION OF THE PREFERRED EMBODIMENT

Figure 1:
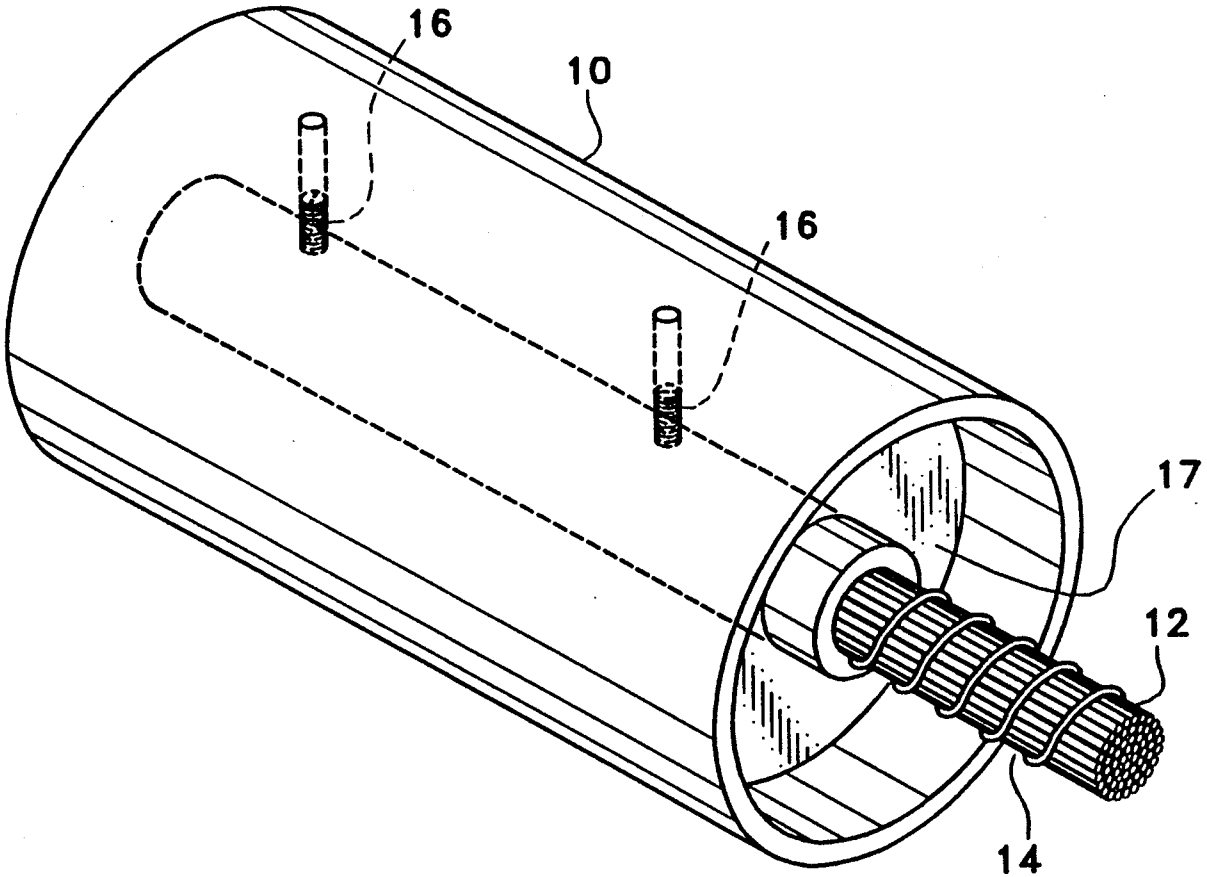
FIG. 1 is a side perspective view of the present invention.

In FIG. 1, a cylindrical base 10 has a bundle of bristles 12 mounted on the axis of base 10. As will be described below, there are advantages to mounting bundle of bristles 12 slightly off axis. Base 10 may be any plastic, metal or other material capable of handling high speed rotation. Bundle of bristles 12 can be made of copper wires, plastic fibers, or other materials that are softer than cartridge case primer pockets to be cleaned. Use of materials with a lower level of hardness avoids abrasions to the primer pocket which damage the primer pocket by wearing it away. A coil spring 14 is placed around bundle of bristles 12. Spring 14 is retractable and can be made of any metal. Spring 14 is not all fastened and may slide over bundle of bristles 12. By not being attached the individual bristles 13 are able to vibrate which helps them stay clean.

Figure 2:
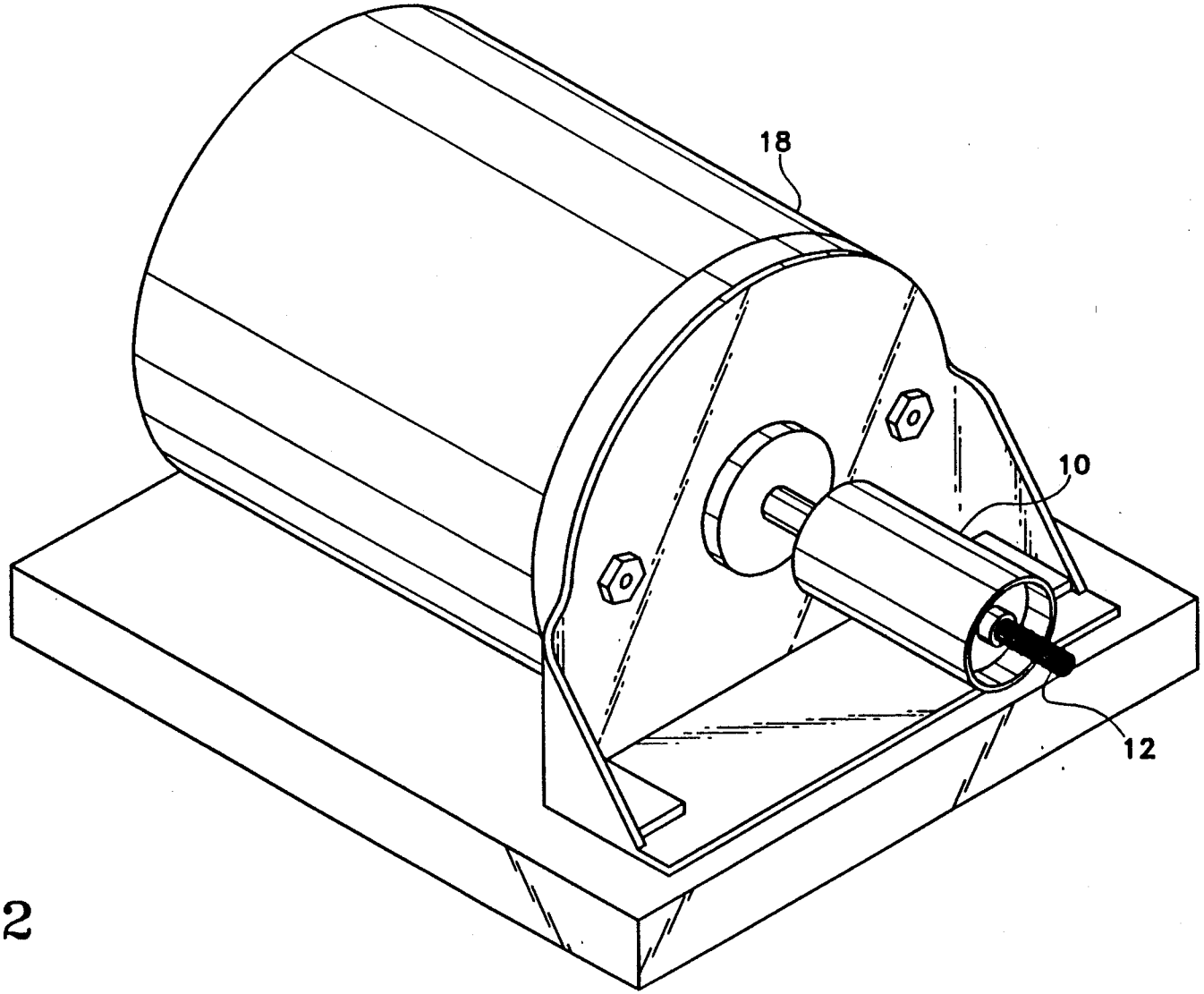
FIG. 2 is an angled view of a motor driven version of the present invention.

Base 10 may be rotated by any turning device, such as a motor 18 as shown in FIG. 2. Referring back to FIG. 1, set screws 16 are one method of attaching base 10 to motor 18. A guard shield 17 may be made either part of the base as shown, or attached as a separate component. Guard shield 17 extends around bundle of bristles 12 to catch anything thrown off as the bundle of bristles rotate.

Figure 4:
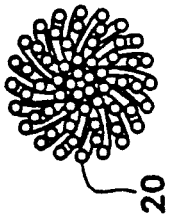
FIG. 4 shows an end on view of the bundle of bristles portion of the present invention.
Figure 3:
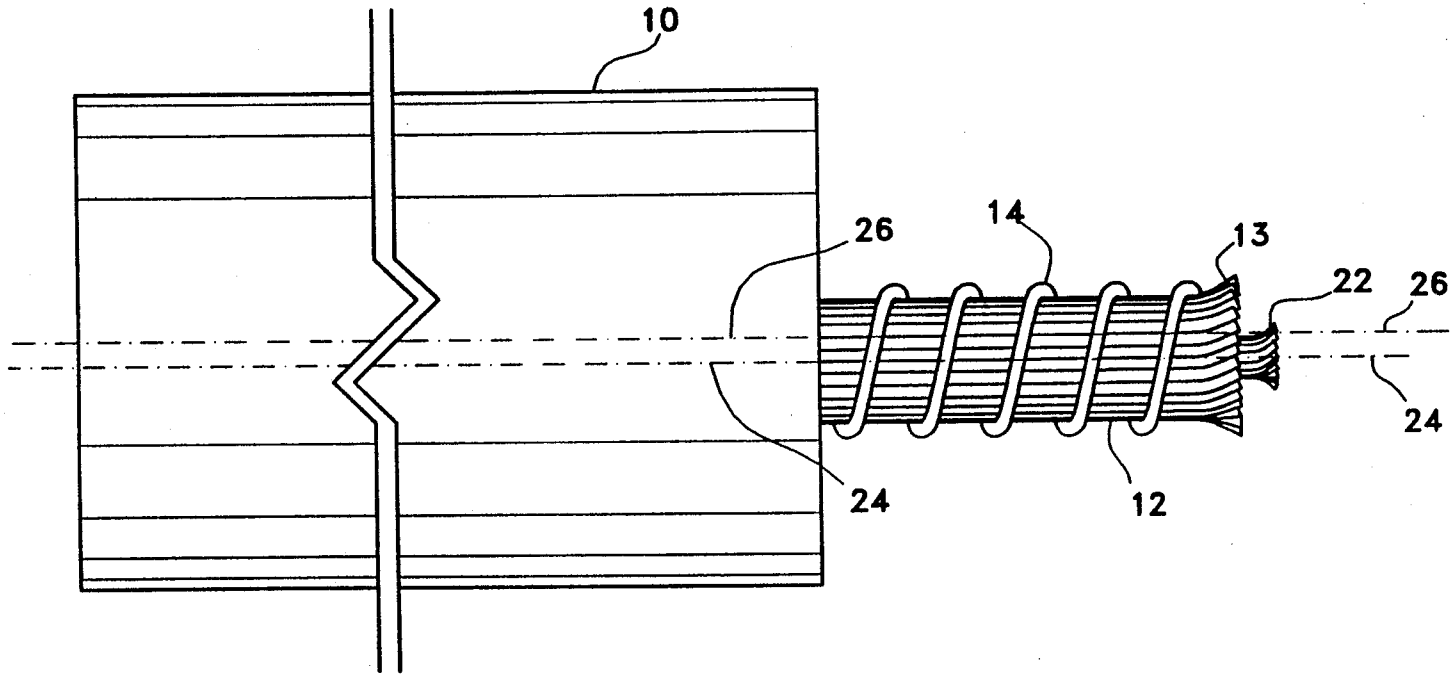
FIG. 3 and 5 is a side view of the bundle of bristles portion for the present invention.

FIG. 3 is a side view of base 10 and bundle of bristles 12. One end of bundle of bristles 12 has a cleaning surface 20. An end on view of cleaning surface 20 is shown in FIG. 4. The central bristles 22 of bundle of bristles 12 may extend above cleaning surface 20 to fit the central portion of the pocket to be cleaned, known as the flash hole. As shown in FIG. 3 and FIG. 4 a scrubbing effect can be produced during the cleaning by mounting bundle of bristles 12 slightly off of the axis of cylindrical base 10. FIG. 3 shows an axis 24 which is the axis of symmetry for bundle of bristles 12. Also shown in FIG. 3 is an axis 26 which is the axis of rotation for base 10. When base 10 is rotated, bundle of bristles 12 does not rotate about axis 24, thus a scrubbing motion results.

When a cartridge case primer pocket is pressed against cleaning surfaces 20, spring 14 retracts allowing penetration to the base of the primer pocket. Individual bristles 13 will flare outward but are limited by the size of the primer pocket. The flare will serve to keep spring 14 from sliding off. Only the portion of bristles 13 exposed by the retraction of spring 14 are able to flare.

Figure 5:
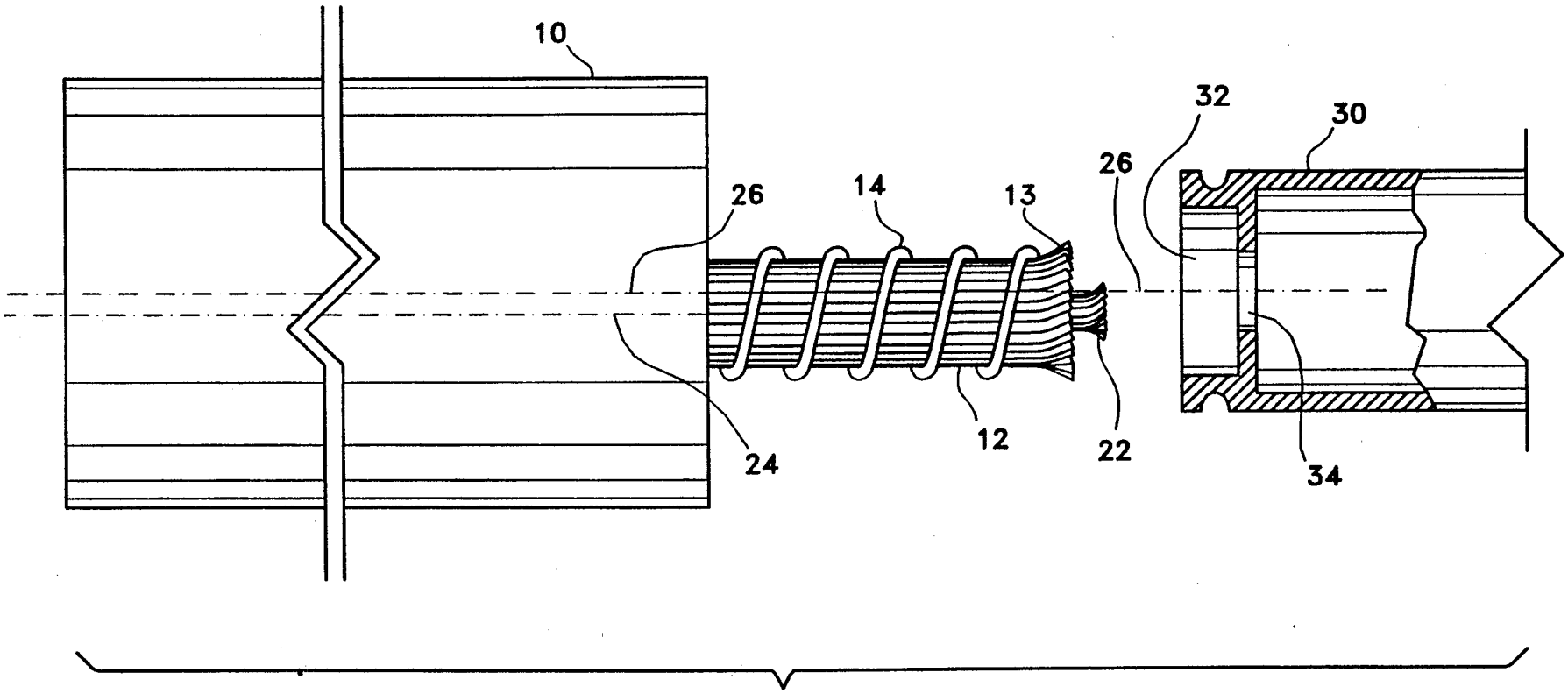

FIG. 5 shows the present invention aligned for use with a cartridge case 30. A cartridge case 30, shown in cross-section, has a primer pocket 32 and a flash hole 34. Cartridge case 30 is pressed against bundle of bristles 12 such that bundle of bristles 12 is inserted into primer pocket 32. Central bristles 22 fit into flash hole 34. Due to the off-center rotation of bundle of bristles 12 and central bristles 22, the bristles shaped into a cleaning surface scrub their way around primer pocket 32 and flash hole 34.

What is claimed is:

1. A primer pocket cleaner comprising:

a base with an axis;

a bundle of bristles with one end of said bundle mounted off center into said base and with a cleaning surface of an outer bundle of bristles and a central bundle of bristles extending above the surface of the outer bundle of bristles on the opposite end of said bundle;

a retracting coil spring surrounding said outer bundle of bristles outside said base to prevent flaring; and a turning device with a mount to hold said base, sch that said base and bristle bundle are rotated by said turning device about the axis of said base.

2. A primer pocket cleaner as described in claim 1 where said bundle of bristles flare as they are used to prevent said coil spring from being able to slip off of said bundle of bristles.

3. A primer pocket cleaner as described in claim 1 where said turning device is a motor.

4. A primer pocket cleaner as described in claim 2 where said turning device is a motor.

5. A primer pocket cleaner as described in claim 1 where said base further comprises a shield guard fastened to said base.

6. A method of cleaning primer pockets on cartridge cases comprising the steps of:

A. mounting a base with an axis to one end of a bundle of bristles having two ends such that said bundle of bristles is mounted off center with respect to said axis of said base;

B. shaping the end of said bundle of bristles into an outer bundle of bristles and a central bundle of bristles extending above the surface of the outer bundle of bristles not mounted to said base into a cleaning surface;

C. placing a retractable coil spring around said outer bundle of bristles to prevent flaring.

D. inserting said base into a turning device which rotates said base and said bundle of bristles;

E. pressing a cartridge case primer pocket against said cleaning surface end of said bundle of bristles while they are rotating.

* * * * *